United States Patent [19]

Metzler, Jr.

[11] 4,188,035

[45] Feb. 12, 1980

[54] CHESS WORD GAME

[76] Inventor: Robert A. Metzler, Jr., 400 W. 43rd St., Apt. 13-H, New York, N.Y. 10036

[21] Appl. No.: 903,830

[22] Filed: May 8, 1978

[51] Int. Cl.[2] ..... H63 3/02

[52] U.S. Cl. ..... 273/260; 273/288

[58] Field of Search ..... 273/260, 261, 288, 289, 273/290, 291

[56] References Cited

U.S. PATENT DOCUMENTS

| | | | |
|---|---|---|---|
| 2,230,332 | 2/1941 | Moore | 273/289 |
| 2,932,518 | 4/1960 | Burros | 273/289 X |
| 2,946,592 | 7/1960 | Post | 273/260 |
| 3,917,272 | 11/1975 | Aldea | 273/288 X |

FOREIGN PATENT DOCUMENTS

| | | | |
|---|---|---|---|
| 788155 | 10/1935 | France | 273/288 |
| 201294 | 8/1923 | United Kingdom | 273/290 |

*Primary Examiner*—Richard C. Pinkham
*Assistant Examiner*—Scott L. Brown
*Attorney, Agent, or Firm*—Anthony J. Casella

[57] ABSTRACT

A game for one or two players comprising a conventional chessboard; pawns and play pieces of two colors having on their front side a different three-dimensional symbol, each symbol representing one of the chess pieces of a chess set and on their back side a slot adapted to removably hold an insert having a letter imprinted thereon above a representation of the symbol appearing on the front of the piece.

6 Claims, 3 Drawing Figures

CHESS WORD GAME

FIELD OF THE INVENTION

This invention relates generally to a chess-like word game using a chessboard which I call "Cassiebo."

DESCRIPTION OF THE PRIOR ART

The prior art, as exemplified by U.S. Pat. Nos. 1,591,639; 2,760,778; 3,624,808; 2,273,932; 3,829,099 and 3,881,731 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or inconvenient to use. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in a game for one or two players comprising a conventional chessboard; pawns and play pieces of two colors having on their front side a different three-dimensional symbol, each symbol representing one of the chess pieces of a chess set and on their back side a slot adapted to removably hold an insert having a letter imprinted thereon above a representation of the symbol appearing on the front of the piece.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 2:
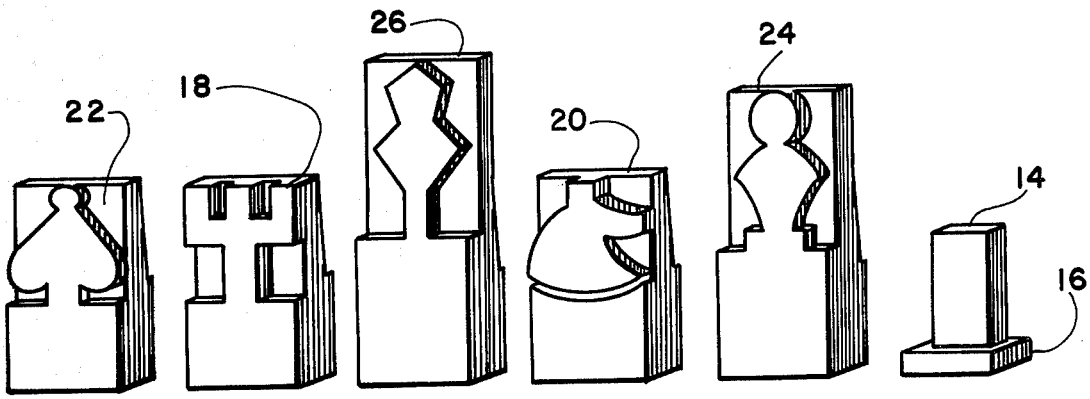
FIG. 2 is a view in perspective showing the game pieces.
Figure 3:
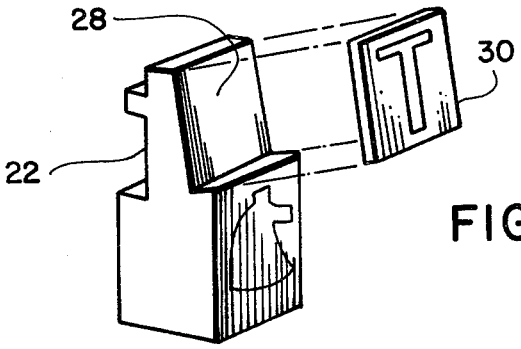
FIG. 3 is a detailed view of a game piece showing positioning of a letter insert.

With reference to the drawing, there is shown and illustrated a chess word game constructed in accordance with the principles of the invention and designated generally by reference character 10. The illustrated tangible embodiment of the invention includes a checkered playing board 12 of cardboard, wood or other suitable material used for making same and two sets of eight pawns of two different colors each consisting of a cube 14 on a wider rectangular base 16 for greater stability. The pawns as well as the other game pieces preferably are molded from suitable molding powders such as "Lexan" polycarbonate or the like. Also provided are four rooks 18; four knights 20; four bishops 22; two queens 24 and two kings 26. These pieces have three dimensional symbols on the front thereof as shown in FIG. 2. On their back they each have a slot 28 for temporarily receiving a letter insert 30 also of plastic or wood. Below slot 28 is a two-dimensional representation of the three-dimensional front symbol. The game also includes fifty to one-hundred letter inserts 30.

Figure 1:
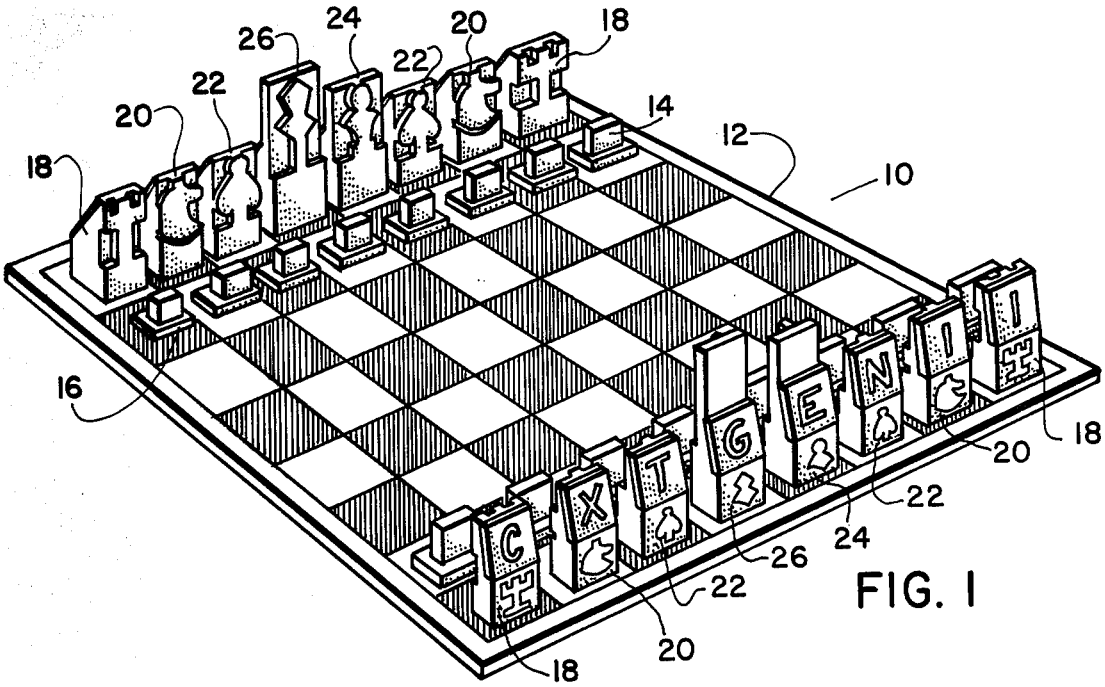
FIG. 1 is a view in perspective of a game board on which are laid out the game pieces at the start of a game.

To play the game, the player or players each place the chess-like playing pieces in their proper positions for a normal chess game, as shown in FIG. 1.

Each player chooses one eight letter playing word from a suggested word list (or one of own choosing), finds the letters, mixes them up, face down, and then, one-by-one, places them on the slots on the back row, or rank, of chess-like pieces beginning at the left. The letters are placed so that only the player who has chosen that word can see the letters. After each letter has been randomly placed in position, the game is ready to be played.

The object of the game is to move the chess-like pieces, according to standard chess moves, about the board, and into position, to spell out the eight letter word, correctly, from left to right.

The following are the basic game rules:

If a player places four or more letters, in their correct position in the word, at the start of the game, he removes the letters, mixes them up, and places them again.

All of the pieces on the board move according to standard chess moves.

To spell out the word correctly, each letter must be in its proper sequence, from left to right, one letter in each of the eight vertical columns of squares, called files. The piece can occupy any square in its proper file.

Each piece has a point value. Pawns equal two points, knights and bishops equal three points, rooks equal five points, queen equal nine points, king equal twelve points.

As a player "takes" his opponents pieces, he accumulates a "Holding Score", which is the total of the point values of the pieces he has taken.

If one or more of a player's letter pieces 30 has been taken, the player continues spelling out his word, without those letter pieces, leaving their position in the word unoccupied.

A player cannot continue making moves once he has spelled out his word correctly. He must declare "game". If he does not, the game is restarted.

If a king is taken, in the process of play, the game is not over. Unlike regular chess, the game continues until a player spells his word.

When one of the players spells out his word correctly, the game is over. The winner is determined by the highest "Holding Score". A Bonus Score of five points is added to the "Holding Score" of the person who spells his word out first.

Players must always beware of your opponents "Holding Score". It is of no value to spell out a word correctly, if a five point bonus score, for spelling the word, will not give a winning "Holding Score". To build up a "Holding Score", one must "take" more of the opponents pieces, prior to spelling the word correctly.

Since a player cannot see his opponents letters. The player will not know how close his opponents is to spelling out his word, so the player should not spend time on needless moves and only take pieces to maintain a higher "Holding Score" or to facilitate placing a letter in its proper sequence. The object is to spell the word out first.

The following standard chess moves are used:

The King: The king can only move one square, but in any direction.

The Queen: The queen can move in any direction, any number of squares at a time.

The Knight: The knight moves (a) one square north or south, then two squares east or west, OR (b) one square east or west, then two squares north or south. Unlike the other pieces, the knight can leap over any man on the playing board.

The Bishop: The bishop moves any number of squares, along the same color diagonal.

The Rook: The rook, or castle, moves horizontally or vertically, any number of squares.

The Pawn: The pawn is the only piece that does not have the ability to also move backwards. The pawn moves forward, one square at a time. When the pawn is making its first move, it has the option of moving one square or two. A pawn only "takes" an opponents piece if the opponents piece occupies a square one forward and to the left or right of the pawn.

As in chess, the process of "taking" occurs when a players man displaces one of his opponents men during a legal move.

The concept of the game hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it forvarious applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A chess word game comprising:

checkered board game;

a plurality of pawns;

a plurality of game pieces, each having on the front thereof a conventional chess symbol in three-dimensions and on the upper part of the back thereof a slot for removably receiving an insert bearing a letter indicia, each game piece having below the respective slot thereof a two-dimensional representation of the chess symbol disposed on the opposite side thereof; and a plurality of inserts, each bearing a letter indicia whereby, when an insert is disposed in each game piece, the game pieces may be moved on said board according to standard chess moves such that the indicia-bearing inserts spell out a multiple letter word.

2. A chess word game as recited in claim 1 wherein each said pawn consists of a cube mounted on a rectangular base.

3. A chess word game as recited in claim 1 wherein the upper part of the back of each game piece is inclined.

4. A chess word game as recited in claim 1 wherein each insert is of generally planar, rectangular configuration.

5. A chess word game as recited in claim 1 wherein the plurality of pawns includes two sets of eight pawns of two different colors.

6. A chess word game as recited in claim 1 wherein said game pieces include four rooks, four knights, four bishops, two queens and two kings.

* * * * *